US010292557B2

(12) United States Patent
Latimer

(10) Patent No.: US 10,292,557 B2
(45) Date of Patent: May 21, 2019

(54) SOLID AND LIQUID WASTE VACUUM

(71) Applicant: Lisa Latimer, Sunnyside, NY (US)

(72) Inventor: Lisa Latimer, Sunnyside, NY (US)

( * ) Notice: Subject to any disclaimer, the term of this patent is extended or adjusted under 35 U.S.C. 154(b) by 152 days.

(21) Appl. No.: 15/254,867

(22) Filed: Sep. 1, 2016

(65) Prior Publication Data

US 2017/0065136 A1 Mar. 9, 2017

Related U.S. Application Data

(60) Provisional application No. 62/212,733, filed on Sep. 1, 2015.

(51) Int. Cl.

| | |
|---|---|
| ***A47L 9/10*** | (2006.01) |
| ***A47L 9/20*** | (2006.01) |
| ***A47L 9/14*** | (2006.01) |
| ***A47L 5/24*** | (2006.01) |
| ***A47L 7/00*** | (2006.01) |
| ***E01H 1/00*** | (2006.01) |

(52) U.S. Cl.

CPC ..... *A47L 9/1427* (2013.01); *A47L 5/24* (2013.01); *A47L 7/0004* (2013.01); *A47L 9/14* (2013.01); *A47L 9/1418* (2013.01); *A47L 9/1481* (2013.01); *E01H 1/006* (2013.01)

(58) Field of Classification Search

CPC .... A47L 9/1418; A47L 9/1427; A47L 9/1436; A47L 9/1445; A47L 9/1463; A47L 9/1481; A47L 9/14; E01H 1/006; E01H 1/1206; B65F 1/068

USPC ..... 220/495.11, 495.08, 495.06, 495.04

See application file for complete search history.

(56) References Cited

U.S. PATENT DOCUMENTS

| | | | | |
|---|---|---|---|---|
| 4,185,355 | A | 1/1980 | Williams | |
| 5,059,223 | A * | 10/1991 | Diebolder | A47L 5/365 15/347 |
| 5,661,873 | A * | 9/1997 | Karet | A47L 5/14 15/344 |
| 5,864,919 | A | 2/1999 | Peneda | |
| 6,647,586 | B2 | 11/2003 | Rogers | |
| 7,003,846 | B2 | 2/2006 | Holtz | |
| 7,404,230 | B1 | 7/2008 | Phillips | |
| 8,916,002 | B1 * | 12/2014 | Landolt | A01G 1/125 134/21 |
| 2007/0157424 | A1 | 7/2007 | Mottahedeh | |

* cited by examiner

*Primary Examiner* — Bryan R Muller
(74) *Attorney, Agent, or Firm* — Kimberly O Snead

(57) ABSTRACT

The invention discloses a system for vacuuming waste having a motor module and a waste module. The motor module has an open receiving area, motor, battery, vacuum tube receiving area and handle. Multiple bag hooks are spaced along the open receiving area. Disposable bags, having a drawstring within a channel, are placed within the waste module. The drawstring has a length greater than the bag perimeter to form multiple bag loops that extend through gaps in the channel. An insert maintains the bags in an open position. The bag loops are placed on the bag hooks so that when the motor module is opened, the drawstring pulls the bag closed.

9 Claims, 13 Drawing Sheets

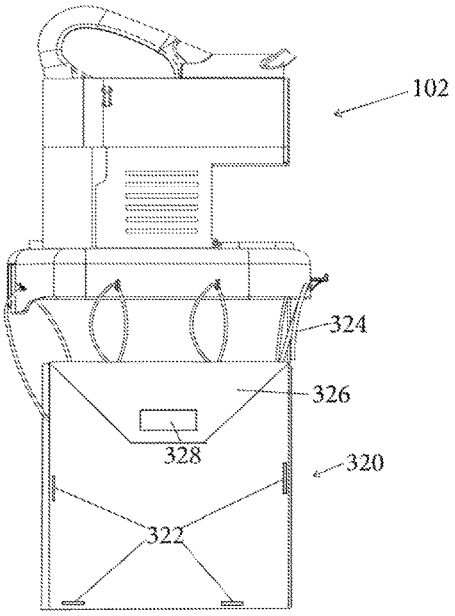
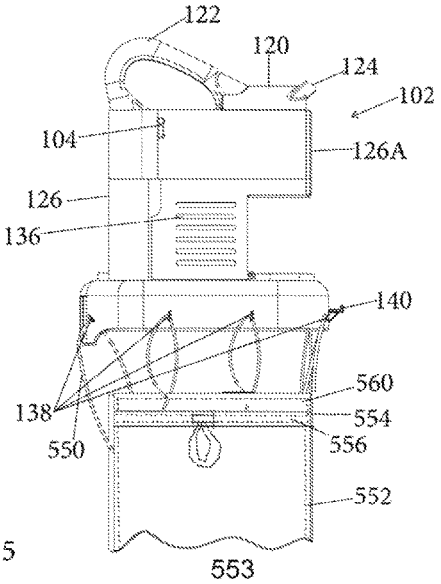
Figure 5
Figure 8
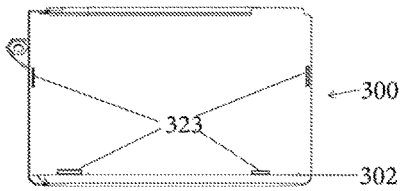
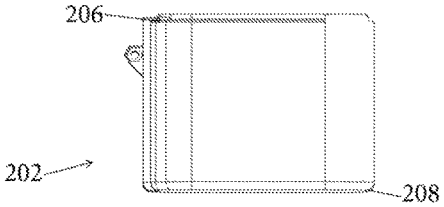

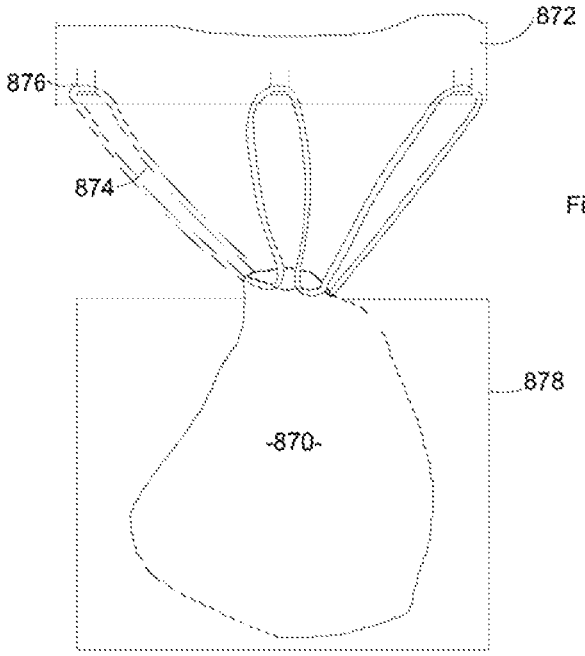
Figure 17
Figure 18
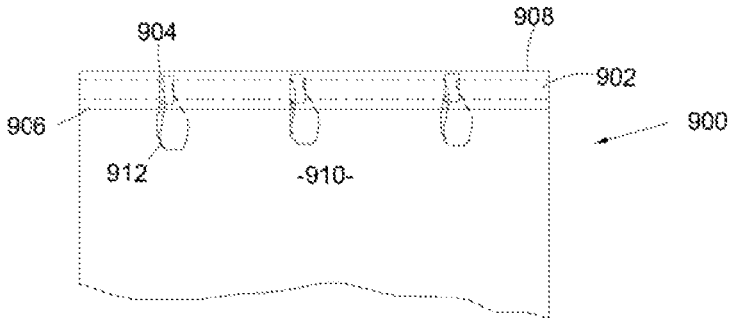

SOLID AND LIQUID WASTE VACUUM

FIELD OF THE INVENTION

A lightweight, portable vacuum system for the collection of animal feces having contact-free removal.

BACKGROUND OF INVENTION

A number of prior art devices have been developed to address the animal feces and urine removal problem. For example, U.S. Pat. No. 4,185,355 entitled "Apparatus For Cleaning Up Animal Feces Deposits" discloses a method and apparatus for cleaning up an animal feces deposit from a situs. The device cleans up the feces by positioning an open-ended receptacle with its open end overlying and in close proximity to the animal feces deposit, providing a suction to pick up the animal feces deposit, and delivering the same into the interior of the receptacle for the receptacle to be removed from the device and discarded. This device, however, contains inherent problems relating to the removal of animal feces.

First, as the device is a very small hand held unit, the entire unit must be placed almost on the ground to properly align the nozzle opening with the feces. For a user unable to bend down due to leg or back problems, this device is useless. Also, for a user with eye sight or depth perception problems, aligning the nozzle opening with the feces will be a problem considering the device blocks the user's view from multiple angles. Second, the device requires a tube that must be attached and removed from the device multiple times during the operation of the device. For a user without sufficient hand strength, this would render the device useless. For the others, this step is an unnecessary inconvenience.

Lastly, the removal of the bag from the device presents difficulty. As illustrated, the bag is significantly larger than the diameter of the tube. Since the bag is removed through the tube, removing a bag full of feces can only be done a portion at time and the user must exercise care to prevent any feces from spilling out of the bag. If, due to the fullness of the bag it gets stuck on the rim of the tube, there is a good possibility that the bag may break causing a terrible mess within the device. Additionally, if the bag does get stuck, the user may be forced to use his or her hand to displace the feces and, thereby, dislodge the bag from being stuck to the tube. In either event, removing the bag from the device is cumbersome and creates potential problems during every use.

For example the vacuum and disposal system for the collection and disposal of animal feces disclosed in U.S. Pat. No. 7,003,846 consists of a vacuum, a vacuum tube, a flexible hose, and an intake tube. The vacuum is created by an electric motor powered by a rechargeable battery and is used to create a suction through the vacuum tube, the flexible hose, and the intake tube to collect the animal feces. A cartridge is inserted into the intake tube to receive the animal feces collected. After collection, a slide mechanism, a bracket, a guide, a cable, spring loaded hinges, and a rotating support frame to enable the vacuum and disposal system to be converted into an unload position for the removal of the cartridge from the intake tube and the ultimate disposal of the animal feces. Alternatively, a compact vacuum and disposal system may be used in smaller areas.

The devices in the prior art address some of the issues however none disclose the easy removal of the collected waste without user contact, portability and the volume to accumulate a sufficient amount of waste.

SUMMARY OF THE INVENTION

The invention discloses a system for vacuuming waste, including but not limited to pet waste, having a motor module and a waste receiving module. The motor module has a body with an open receiving area having a perimeter, a motor, a removable battery in electrical communication to provide power to said motor, a vacuum tube receiving area and a handle. At least one motor module locking member is located proximate the open receiving area. Multiple bag hooks are spaced a predetermined distance from adjacent bag hooks along the perimeter, and spaced a predetermined location on said perimeter relative to said open receiving area. In one embodiment the bag hooks are positioned on an exterior side of the body and in another they are position on the interior of the body.

The waste receiving module has a receiving member with an open top perimeter dimensioned to receive the open receiving area of the body and at least one receiving module locking member, to interact with said at least one motor module locking member. In one embodiment one of the receiving module locking members and motor module locking member is a hinge and another of the receiving module locking members and motor module locking member is a clasp or the like Disposable bags having at least one side, a closed base and an open top have a bag perimeter less than the open top perimeter of the receiving member. A drawstring channel, is proximate the bag open top with gaps exposing a drawstring within the channel. The drawstring has a length greater than the bag perimeter to form multiple bag loops. Channel gaps are positioned along the drawstring channel and spaced a predetermined distance from adjacent channel gaps equal to the predetermined distance of the bag hooks to receive said bag loops. The bag can have a height equal to or less than the height of the receiving module depending on the location of the vacuum receiving area.

In one embodiment the motor module and waste receiving module are rectangular with the vacuum tube receiving area recessed within the motor module. In another embodiment the vacuum tube receiving area is placed in the waste receiving module. The configuration of the vacuum can be other than rectangular based on manufacturing convenience. The vacuum tubes are removably affixed to the vacuum tube receiving area and can have removable attachments.

To maintain the bag in an open position, an insert dimensioned to be received within the bag can be used. The insert can have a number of configurations including at least two sides and a bottom, at least three sides or a bottom and manufacture from a material such as cardboard. The insert can have a height equal to, less than or greater than the height of the bag. In some configurations the bag has a suction collar on one of the sides having an inlet dimensioned to receive the suction tube. Alternatively the disposable bag has two layers separated by an insert.

As an alternative method of maintaining the bag in an open position multiple pairs of magnets can be used. One of each of the pairs of magnets being affixed to the waste receiving module and a second to the bag.

To use the vacuum system the motor module is opened and a disposable bag into the waste receiving module. The bag loops are placed on the bag hooks and the motor module locked to the waste receiving module. The suction tubes are inserted into the vacuum receiving area and the vacuum turned on. The waste is vacuumed and when completed, the motor module is opened. As the motor module is opened the bag loops are pulled by the bag hooks, causing the bag to close. The bag loops are then removed from the bag hooks and the closed bag disposed of without user contact with the vacuumed waste.

BRIEF DESCRIPTION OF THE DRAWINGS

These and other objects, features, advantages and aspects of the present invention can be better understood with reference to the following detailed description of the preferred embodiments when read in conjunction with the appended drawing figures.

FIG. 5 is an exploded side view of the vacuum showing the bag attachments in accordance with the invention;

FIG. 8 is side view of an alternate bag and waste receptacle embodiment having a bag with a fold top and magnets as retaining members in accordance with the invention;

FIG. 17 is a plan design of the bag being removed from the waste module in accordance with the invention, FIG. 18 is a plan design of the bag for used with the disclosed vacuums in accordance with the invention.

DETAILED DESCRIPTION OF THE INVENTION

List of Components

Figure 1:
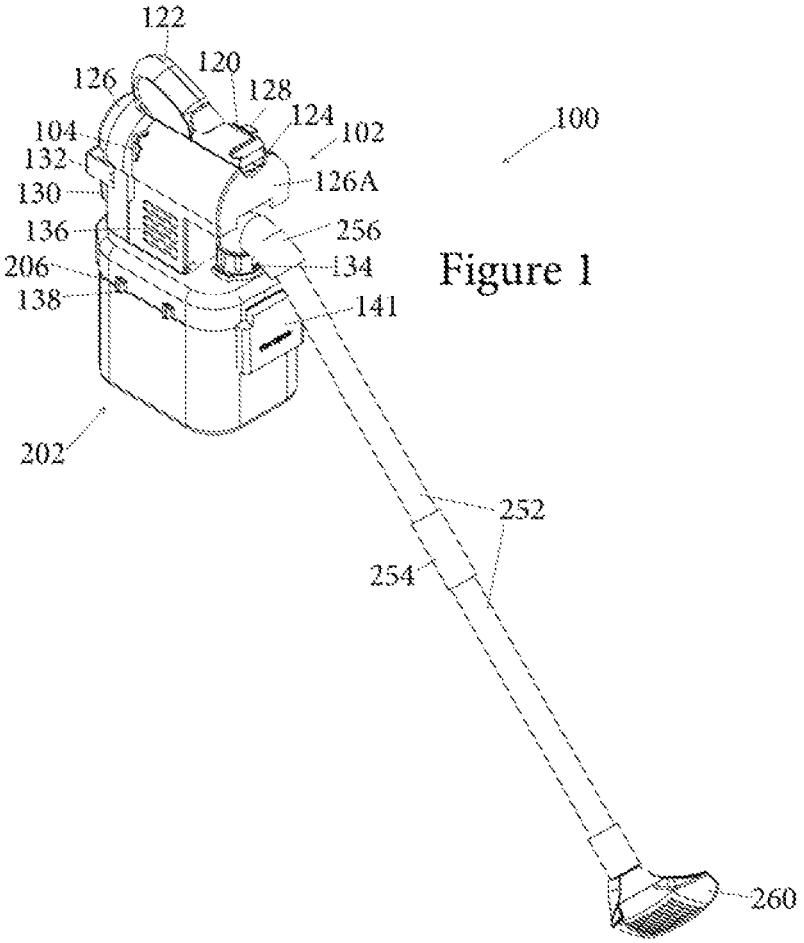
FIG. 1 is a perspective view of the vacuum in accordance with the invention.

100 vacuum
102 motor module
104 strap receiving loop
105 Carry Strap
120 handle module
122 handle
124 light
126 motor module casing
126A motor module casing front plate
128 on/off switch
130 battery
132 battery locking member
134 suction tube receiving member
135 suction inlet
136 air vent
138 bag hooks
140 front locking flange
141 front snap lock
142 base plate
144 suction inlet sleeve
146 securing inlets
148 motor
150 bag loops
152 bag
154 Drawstring Channel
156 Drawstring
158 Bag Gaps
170 Insert
202 waste receiving module
206 locking ridge
208 Base of Waste Receiving Module
252 suction tubes
254 suction tube straight connector
256 suction tube curved connector
260 scoop attachment
262 narrow inlet attachment
264 waste attachment
266 large waste attachment
280 Hinge
300 waste receiving module containing magnets
302 waste receiving module base
320 bag containing magnets
322 bag magnets
323 magnets
324 loops
326 fold over 88) 328 adhesive tab
400 vacuum
402 motor module
404 bag loops
410 bag
412 insert
420 bag hooks
450 waste receiving module
452 base
454 edge
456 rim

500 bag
502*a-c* insert sides
504 U shaped insert
506 bottom plate insert
550 Bag Loops
552 Bag
553 Bag Insert
554 Drawstring Channel
556 drawstring
560 bag rim
570 insert
572 fold area
574 drawstring channel
576 bag loops
600 bag unit
602 outer bag
604 inner bag
606 insert
608 channel
610 bag loops
630 bag
632 insert
634 bag
700 vacuum
702 waste receiving receptacle
704 motor module
706 battery
708 motor
710 handle
712 light
714 hose sleeve
720 flexible hose
722 hose connector
724 bag hooks
722 hose connector
750 bag
752 entry port
754 insert
756 bag loops
758 drawstring
800 bag/insert
802 bag
804 insert
806 bag loops
850 notch
854 side panel
870 bag
872 motor module
874 bag loops
876 bag hooks
878 waste receptacle module
900 bag
902 drawstring
904 loop holes
906 seal line
908 edge
910 plastic body
950 bag unit
952 body
954 drawstring
956 bag loops
958 collar
960 sleeve port
962 base insert
964 channel
966 top
912 bag loops
980 bag unit
982 insert
984 body
986 bag loops
990 vacuum sleeve port
992 collar
994 channel

Definitions

As used herein the term "magnet" shall refer to any material, hard or soft, that exhibits the properties of magnetism.

Collecting and disposing of animal feces and urine, especially for dogs, is an unwelcome task that, in many areas, must be undertaken frequently. The disclosed pet waste vacuum is a lightweight method to pick up and dispose of pet waste without concern of contact. Although designed for the picking up of pet waste, it can be used to pick up any material, such as spilled food or liquids from the ground without bending.

The disclosed vacuum can be manufactured from any easy to wash, light-weight non-porous material, although plastics and composites do add the advantage of being able to be manufactured in colors. It is advantageous, although not mandatory, to have all items capable of being sterilized to prevent the spread of disease in kennels. The size of the collection module can be based on quantity of waste to be picked up, smaller for home use and larger for kennels. The pet vacuum as illustrated in the Figures is only one configuration that would be applicable to the invention. For example, the handle can be eliminated and only a strap used to carry the unit. The top of the unit can be square or the perimeter of the unit round.

FIG. 1 shows the pet vacuum 100 fully assembled and ready for use. The vacuum 100 consists of two modules, the motor module 102 and the waste receiving module 202. The motor module 102 is secured to the waste receiving module 202 through the use of locking mechanisms, such as the hasp latch 141 illustrated.

The motor module 102 contains the handle module 120 that consists of a shaped, preferably ergonomic, handle 122 and light 124. The light 124 is preferably LED or other efficient, high intensity lighting and angled to shine light onto the area contacted by the suction tube 252. The light bulb should be recessed within the light 124 to prevent breakage while still permitting easy replacement. Batteries to power the light can be stored behind the bulb or the light can be powered directly from the main battery 130. In this embodiment the light 124 is turned on and off by twisting the unit, however an on/off switch or button can also be placed in a convenient location.

Figure 4:
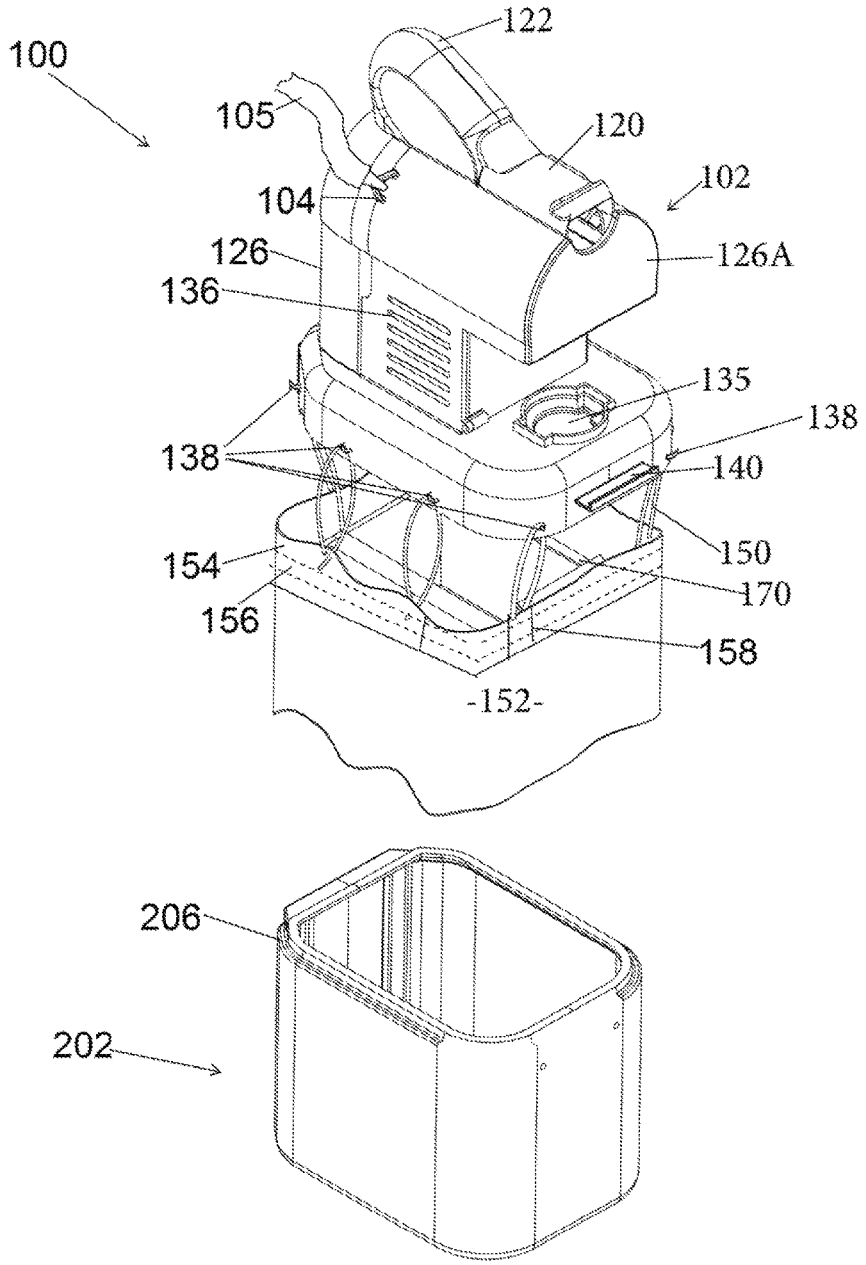
FIG. 4 is an exploded perspective view of the upper body with bag attachments in accordance with the invention.

A strap receiving loop 104 can be placed on either side of the motor module casing 126 to permit the addition of a carrying strap 105 illustrated in FIG. 4. In the preferred embodiment the carrying strap would be adjustable and manufactured in a non-slip material. If intended to supplement or replace the handle 122, the placement of the strap receiving loop 104 should balance the vacuum 100 as much as possible. If to be used for hanging the vacuum 100, the strap receiving loop 104 would be placed more toward the rear of the unit. The placement will depend on intended use and will be known to the manufacturer.

The motor module casing 126 and motor module casing front plate 126A are preferably manufactured from a rigid, easy to clean plastic, resin, or other equivalent material. As the unit is carried, the material of manufacture should be lightweight and able to withstand being dropped. The motor module 102 as illustrated has a curved top, adjacent the handle module 120, and straight sides. The air vents 136 are placed on each side to prevent overheating. This is an example configuration and the top can be square or the entire unit round, oval or other design preferred by the manufacturer.

The battery 130 in this example is connected to the back of the motor module 102 and held in place by the battery locking member 132. In the preferred embodiment a rechargeable battery, such as used in power tools, is used to provide sufficient power while minimizing weight. As an alternative a number of D cell batteries can be used, however that would increase both size of the unit and weight.

The battery locking member 132 as illustrated is a snap on unit having flanges that interact with receiving areas within the motor module casing 126. This is a quick and easy method for the user to affix and remove the battery 130 for recharging. Other methods of removably affixing the battery, such as wing nuts, Velcro®, etc., will be known to those skilled in the art.

In this embodiment the on/off switch 128 is at the side of the motor module 102, easily accessible while holding the vacuum 100. Alternatively the on/off switch can be placed at the top of the handle module 120. Other locations for the placement of the on/off switch can be utilized depending upon the handle design.

Along the open, bottom edge of the motor module 102 are the bag hooks 138. In the illustrated embodiment there are two hooks on each of the four sides of the motor module 102, as more clearly illustrated in FIG. 4, although in other embodiments additional side bag hooks are illustrated. The number and placement of the bag hooks will be dependent upon size of the unit and will be apparent to those skilled in the art. As the bag hooks 138 receive the bag loops 150, the bag loops 150 will be placed between the motor module 102 and the waste receiving module 202 upon assembly for use.

The hooks 138, applicable to most applications, are about 0.5 cm wide, extend upward about 1.5 cm to about 2 cm and extend from the motor module casing 126 about 0.5 cm. The hooks 138 can be molded as part of the motor module casing 126 or, depending on material of manufacture, added subsequently. In some applications heavier duty hooks 138 can be required and will be known to one skilled in the art in conjunction with the teachings herein.

The suction tube(s) 252 are attached at the proximal end to the motor module 102 by the suction tube curved connector 256 that interacts with the suction tube receiving member 134. In this embodiment two suction tubes 252 are connected through use of the suction tube straight connector 254, although more or fewer suction tubes 252 can be used. At the distal end of the suction tube 252 the scoop attachment 260 has been attached.

The waste receiving module 202 has a periphery configured to interact with the motor module 102 with the motor module 102 resting on a locking rim 206. Alternatively, a locking rim can be placed within the motor module 102 with the edge of the waste receiving module 202 being inserted into the motor module 102. The interaction between the two units can have several designs which are well known in the art. The waste receiving module 202 and the motor module 102 are locked together through use of a draw latch 141. The draw latches 141, or locking dips, are used in a number of wet dry vac designs and are a convenient method to handle the release and securing of the waste receiving module 202 to the motor module 102. Examples of other methods of closure that can be used would be hasp latches, toggle latches, etc. and the draw latch illustrated herein should not be considered as the only method of achieving the result. Although the latch 141 is illustrated in the front of the vacuum 100, it can also be placed at the back of the unit with the hinge 280 (FIG. 3) placed in the back of the unit.

Figures 2, 2A, 2B, 2C:
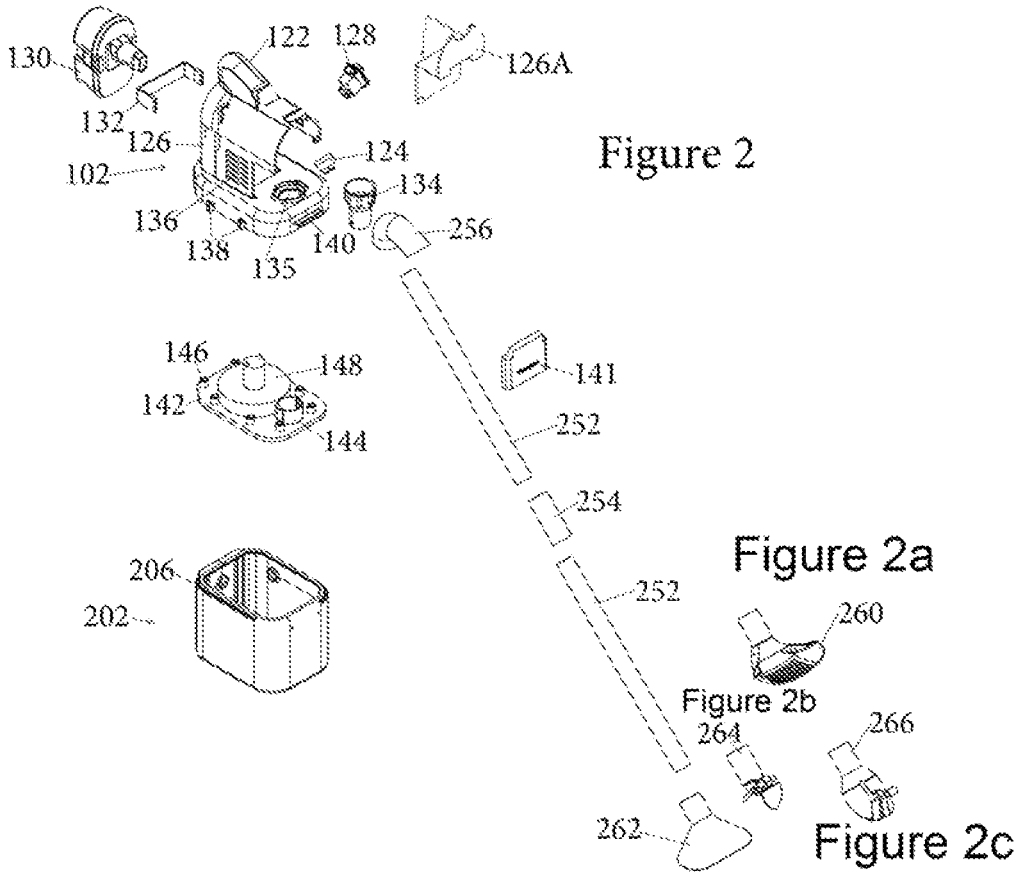
FIG. 2 is an exploded view of the vacuum in accordance with the invention.
FIG. 2*b* is an attachment for picking up solids having a cover in accordance with the invention.
FIG. 2*a* is the scoop attachment in accordance with the invention.
FIG. 2*c* is an attachment for picking up solids having a wider opening than the embodiment of 2*b* in accordance with the invention.

In FIG. 2 the vacuum 100 has been exploded to more clearly illustrate the parts and their assembly. Additionally, in this figure the motor 148 and base plate 142 are illustrated.

The base plate 142, carrying the motor 148 and suction inlet sleeve 144, is connected to the motor module 102 through use of bolts (not shown) placed through the securing inlets 146 into the motor module 102. This is one method of assembly and others will be known to those skilled in the art.

Example attachments are also illustrated in FIGS. 2, 2*a*, 2*b*, and 2*c*. In FIG. 2 the narrow inlet attachment 262 is illustrated which would be used for liquids or small items. In FIG. 2*a* the scoop 260 is illustrated that would be used for picking up feces or other solid or semi solid item. FIG. 2*b* is an embodiment for use with picking up solids having a cover that flips open to prevent contact with the solid. FIG. 2*c* is an embodiment similar to that of FIG. 2*b* with a larger collection area.

Figure 3:
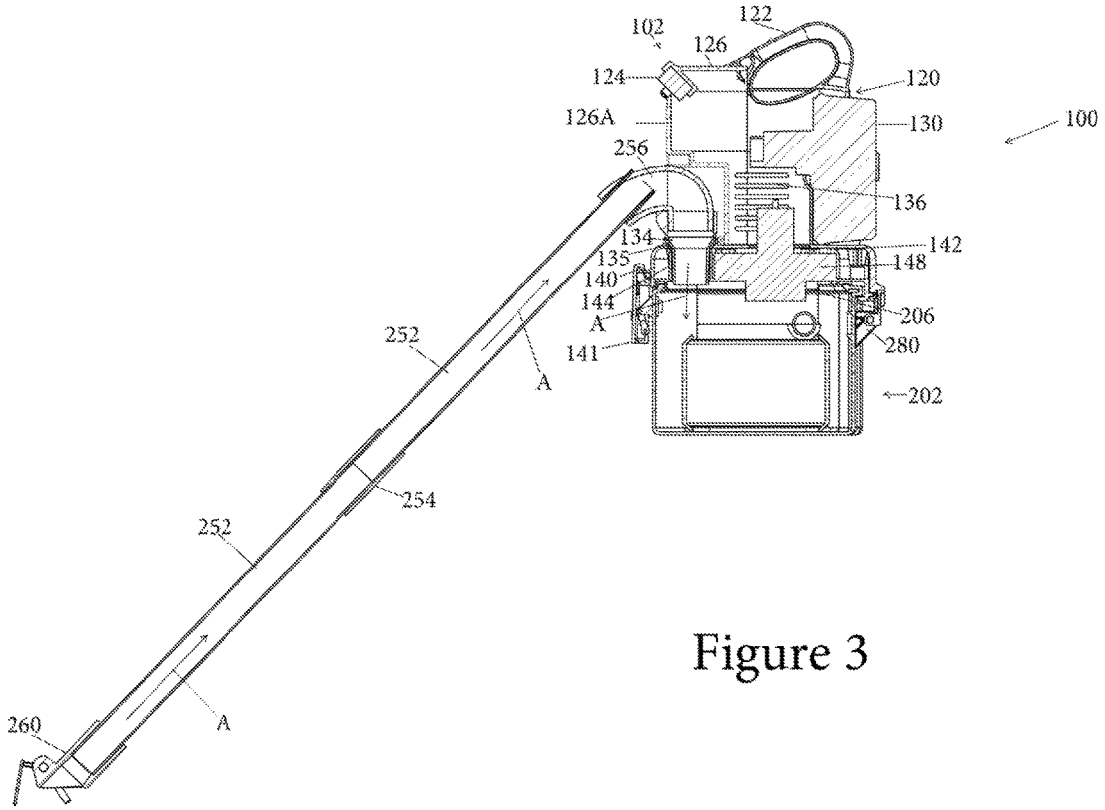
FIG. 3 is a cutaway side view of the vacuum in accordance with the invention.

FIG. 3 shows the assembled vacuum 100 in a cutaway to better illustrate the placement of the parts and assembled compactness of the vacuum 100. In this figure the path of the waste into the bag 150 is clearer. As seen in this figure the waste flow, as indicated by arrows A, progresses from the scoop attachment 260, or other attachment, through the suction tubes 252, suction tube curved connector 256, suction tube receiving member 134 and into the bag-lined waste receiving module 202. The suction tube straight connector 254 must have a friction fit with the suction tubes 252 sufficient to prevent inadvertent disconnection while still permitting removal. This type of connection is known in the vacuum cleaning arts and the dimensioning will be known to those skilled in the art.

It is important that the suction receiving member 134 has sufficient length to extend close to the locking ridge 206 while not extending beyond the bottom edge of the motor module 102. The placement is such that the waste falls directly into the bag 152 while preventing inadvertent contact when removing the bag 152. The suction tube receiving member 134, while being removable from the suction tube receiving member 134 and adjoining suction inlet sleeve 144 must have a sufficient friction fit to prevent movement.

The air vents 136 are placed such that the motor 148 is prevented from overheating. The battery 130 is placed so as to maintain an outer periphery close to that of the waste receiving module 202 hinge assembly 280, maintaining the compactness of the vacuum 100. The motor module casing front plate 126 is designed to position the suction inlet sleeve 144 to direct the waste into the waste receiving module 202

The angle of the light 124 is also seen more dearly in this figure as is the interaction between the motor module casing 126 and the handle module 120. As noted, the design of the handle 122 is an example of a design and other configurations can be used. Additionally, although a rigid, non-porous plastic is ideal for the motor module 102, waste receiving module 202 and suction tubes 252 for cleaning purposes, it can be beneficial to the user to have the handle 122 slightly padded, or covered, with a easily cleanable material, such as rubber or polyurethane. Alternatively, the handle module 120 can be manufactured from a material lower on the durometer scale than the motor module 102 and waste receiving module 202.

As seen in this Figure, the base plate 142 is mounted to the underside of the motor module 102, placing the suction inlet sleeve 144 adjacent to, and aligned with, the suction inlet 135. It is preferable that the securing method permit the base plate 142 to be removed in the event the motor 148 requires replacement. This is easily done through bolts placed within the securing inlets 146 (FIG. 2).

In the illustrated embodiment the motor module 102 is hingably connected to the waste receiving module 202 through hinge unit 280 and locked together through the front snap lock 141. Alternatively a second front locking flange 140 and front snap lock 141 can replace the illustrated hinge unit 280, making the motor module 102 completely removable from the waste receiving module 202.

In FIG. 4 the placement of the bag hooks 138 is shown with the bag loops 150 hooked and holding the bag 152 in position. The drawstring channel 154 contains the drawstring 156 that forms the bag loops 150. In manufacture the drawstring 156 is given sufficient excess to enable the bag loops 150 to extend through the bag gaps 158. In this way the bag loops 150 will pull the drawstring 156 as the motor module 102 is removed, closing the bag 152 for removal. The bag 152 is dimensioned to be received within the interior of the waste receiving module 202. When the bag hooks 138 are on the exterior of the motor module 102, the length of the bag loops 150 is not overly critical as the loops will be prevented from falling off the bag hooks 138 by the fact that they are secured between the motor module 102 and the waste receiving module 202. The bag loops 150 should be close to the distance between the bottom of the waste receiving module 202 and the bag hook 138 to prevent the bag 152 from falling off during insertion into the waste receiving module 202.

One of the advantages of the disclosed design is the automatic closing of the bag upon removal of the motor module 102 from the waste receiving module 202. This is best accomplished by having all loops as part of a continuous drawstring as illustrated hereinafter. However, it should be noted that fewer bag loops can be part of the drawstring with the non-attached loops being removed by hand at the time of removal of the motor module.

In the embodiment illustrated in FIG. 5 the bag loops 550 are placed in the bag rim 560 of the bag 552 that is above the drawstring channel 554. To form the drawstring channel 554, the material is folded over and sealed to form the top and the bottom of the channel 554 to receive the drawstring 556. This results in a doubling of the material in the bag rim 560 that provides the required reinforcement to prevent tearing in most sizes. In large vacuums, an additional layer of reinforcement can be required. Similar to a garbage bag, the bag 552 has a pair of drawstring handles that are pulled to close prior to removing the bag 552. For user convenience it is preferable that the drawstring in this and other embodiments is about 0.5 inch wide. Within the bag 552 is the insert 553 that serves to maintain the bag 552 in position within the waste receiving module 202. Although not as convenient to use, this embodiment permits the loops to go through the cardboard insert for heavier duty uses. In this design it would be preferable to use a lightweight cardboard for the insert as it will need to crush as the drawstring closes.

Figure 6:
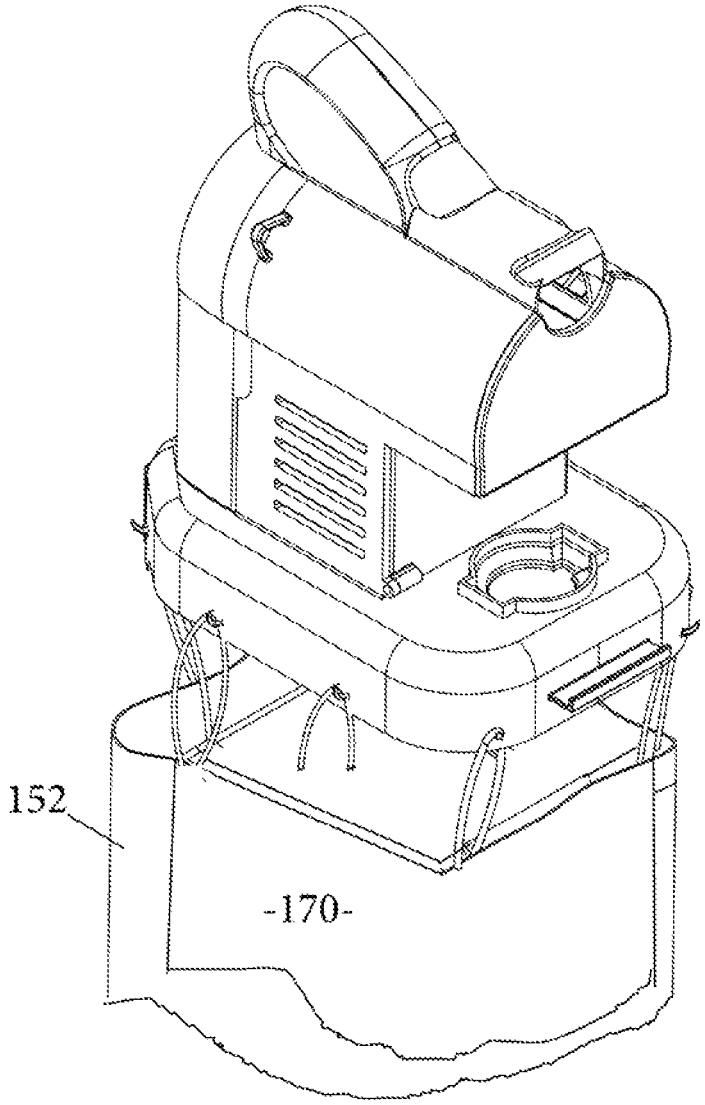
FIG. 6 is a perspective view of an insert for use with the bag in accordance with the invention.

In FIG. 6 the insert 170 is more dearly shown within the bag 152. The insert 170 in this embodiment is a foldable cardboard rectangle with a periphery slight less than the periphery of the bag 152. This enables the insert 170 to be slid into the bag 152, maintaining the bag 150 in an open position as well as sitting on the base 208 of the waste receiving module 202. As the plastic of the bag 150 will encompass the insert 170 and retain the waste, the insert only requires side pieces. Additional insert embodiments are illustrated hereinafter.

The bags 150 must be seepage and tear resistant and being capable of holding the weight of a waste receiving module 202 full of fecal matter. In most applications, a thickness of between about 3 mil and about 6 mil is preferred, however for large units the thickness could need to be increased. The material is preferably a plastic, such as polyethylene or polypropylene, although other materials that meet the same requirement can be used.

In one embodiment the insert 150 is manufactured from a slick plastic and removed and reused. This however, can be objectionable to many people and therefore it is preferred that the insert 170 be manufactured from cardboard and disposable with each bag 150 use. The insert 170 has four sides and is a separate unit from the bag 152. Alternative insert combinations are disclosed hereinafter.

Figure 7:
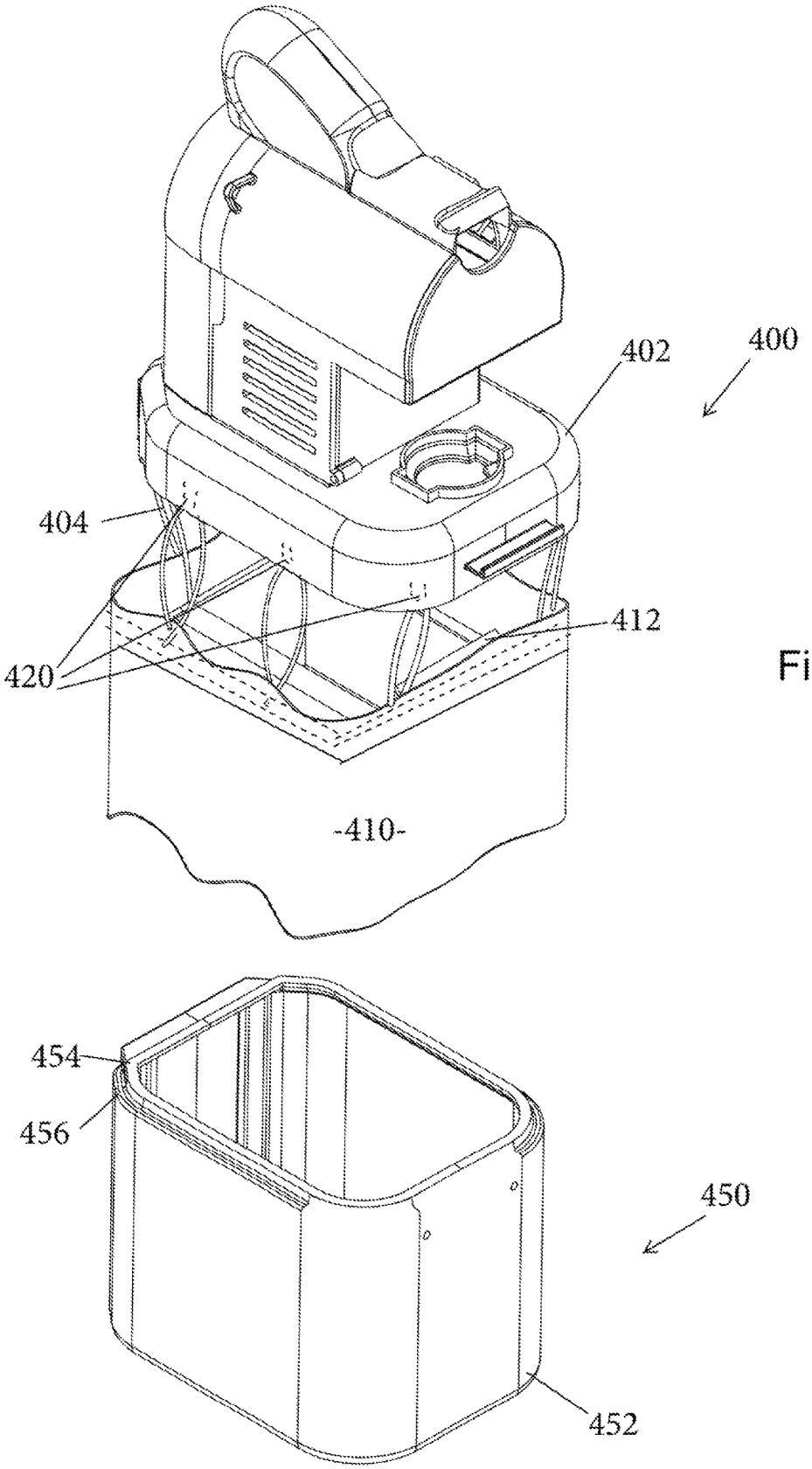
FIG. 7 is an exploded side view of an alternate embodiment of securing the bag in accordance with the invention.

In the vacuum 400 illustrated in FIG. 7 the bag hooks 420 are on the inside of the motor module 402. In this design the bag loops 404 need to be slightly less than the distance from the bag hook 420 to the base 452 of the waste receiving module 450 minus the height of the bag 410. Unlike the embodiments with the bag hooks on the exterior of the motor module, the loops 404 in this embodiment will not be pressed between the motor module 402 and the waste receiving module 450 and must, therefore, have the appropriate length. In this configuration, the weight of the bag 410 and insert 412 will hold the loops 404 on the hooks 420 until waste is brought into the bag 410. Having the bottom of the bag 410 slightly above the base 452 of the waste receiving module 450 will also assist in maintaining the loops 404 in position.

In this embodiment the edge 454 and rim 456 of the waste receiving module 450 must be dimensioned to avoid contact with the bag hooks 420. Alternatively, the rim can be placed on the inside of the waste receiving module 450 and the motor module 402 sit within. The configurations required to affix one module to another are well known in the wet/dry vacuum art and the dimensioning can be determined in conjunction with the disclosure herein. It should be noted that the detailed bag design is not illustrated in this embodiment as bag designs are disclosed in greater detail hereinafter.

In FIG. 8 an alternate waste receiving module 300 and bag 320 design is illustrated. The waste receiving module 300 has at least four, and preferably 8, magnets 323 affixed to the base 302 and sides. The bag 320 has loops 324 as described heretofore and, in addition, has at least four magnets 322 at the base of the bag 320 and at least one on each side. The magnets 320 are positioned to interact with the magnets 324 and hold the bag 320 in place. Alternatively, a thin plate can replace either the magnets 324 or 322, to make positioning easier. Although the waste receiving module 300 would be slightly different than the waste receiving module 202, through the addition of the magnets 324, the design of the motor module 102 would not change.

Also illustrated in this figure is an alternative closure in the form of a fold over 326 and adhesive tab 328. In this embodiment, to close the bag 320, the adhesive tab 328 would be peeled to expose the adhesive portion of the tab, the fold over placed over the opening of the bag 320 and secured by the adhesive tab 328. This method of closing bags is known in the art for closure of bagged items such as coffee, raisins, etc. Other closure methods as known in the art can also be used.

Figure 9A:
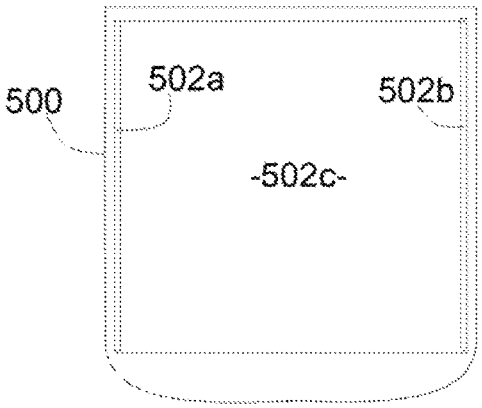
FIG. 9*a* is a cutaway side view of a cardboard insert having four sides in accordance with the invention.
Figure 9B:
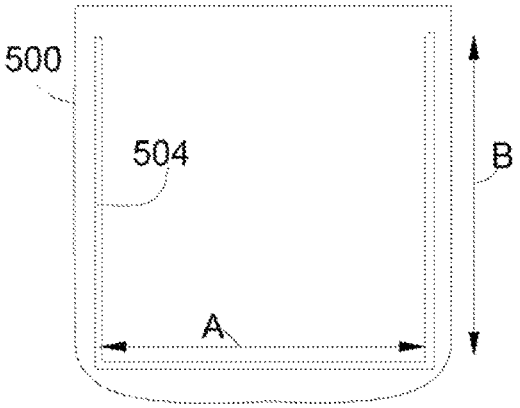
FIG. 9*b* is a cutaway side view of an alternate cardboard insert having two sides and a bottom in accordance with the invention.
Figure 9C:
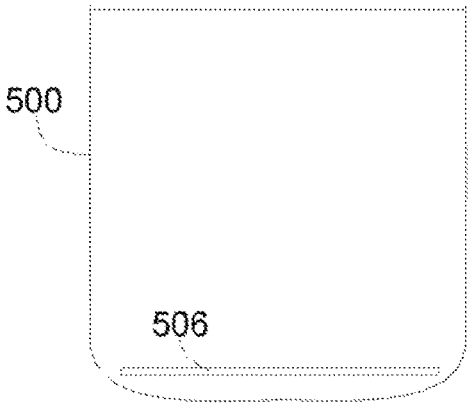
FIG. 9*c* is a cutaway side view of an additional cardboard insert having only a bottom in accordance with the invention.

There are a number of designs, in addition to those noted above, that can be used for the cardboard insert into the bag 500 as illustrated in FIGS. 9*a*-9*c*. In FIG. 9*a* the cardboard insert has three sides 502*a*, 502*b* and 502*c* with no bottom plate. This design is most applicable for a stiffer cardboard that will resist collapsing in on itself. It is preferable that sides 502*a* and 502*b* have a length slightly less than 502*c* to permit the insert to fold flat. An additional fold line, as known in the art, should be added to either side 502*a* or 502*b* to permit it to smoothly lie on top of the first folded side. In FIG. 9*b* the insert 504 is a U shape with the height B being less than the base A, again to enable folding flat. As with FIG. 9*a* an additional fold line will permit the insert to fold flat. In FIG. 9*c* the insert has only a bottom plate 506 that is placed at the bottom of the bag 500. In this embodiment the dimensioning would be most effective with the perimeter of the bottom plate 506 being slightly less than the interior perimeter of the waste receiving module 202 to prevent movement.

Figure 10:
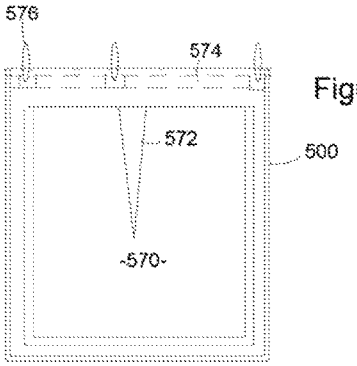
FIG. 10 is an alternate bag design bag design having a fold slit in the insert in accordance with the invention.

In FIG. 10 the insert 570 is a four sided box with a bottom that is placed within the bag 500. In use the insert 570 is closer to the size of the bag 500 however for illustration clarity, the insert 570 is smaller than the bag 500. The top edge of the insert 570 is below the draw string channel 574 to permit closure as the bag loops 576 are drawn up upon removal of the motor module. In order to permit the insert 570 to collapse within the bag 500, a fold area 572 can be provided when heavier material is used. The fold area 572 can be a single slit, a cut-out 572 as illustrated, or any other design that can permit the bag 500 to close. This is the most rigid of the insert designs and can use a lighter weight material than most designs.

Figure 11:
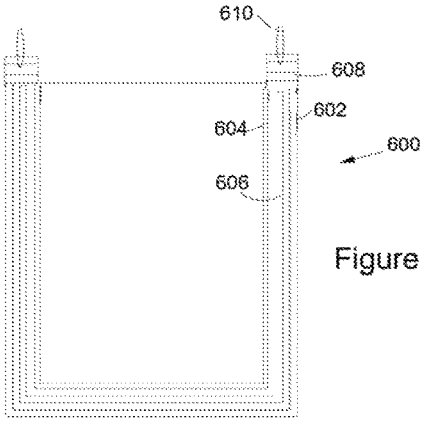
FIG. 11 is another bag design having the insert encompassed within two bags in accordance with the invention.

In FIG. 11 the bag unit 600 consists of an outer bag 602 and inner bag 604 separated by an insert 606. The outer bag 602 and inner bag 604 extend beyond the insert 606 to form a channel 608 that, as noted heretofore, has extensions to form the bag loops 610. This illustration is, as noted above, shown with the element separated for easy visualization.

Figure 12:
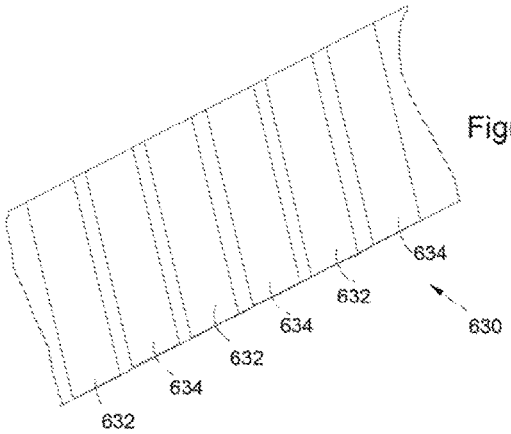
FIG. 12 is an example of packaging for the bags and inserts in accordance with the invention.

In FIG. 12 an example of packing is illustrated with the bag 634 being placed adjacent to the insert 632. Alternatively the bags and inserts can be stacked one on top of another in any manner convenient for packaging.

Figure 13:
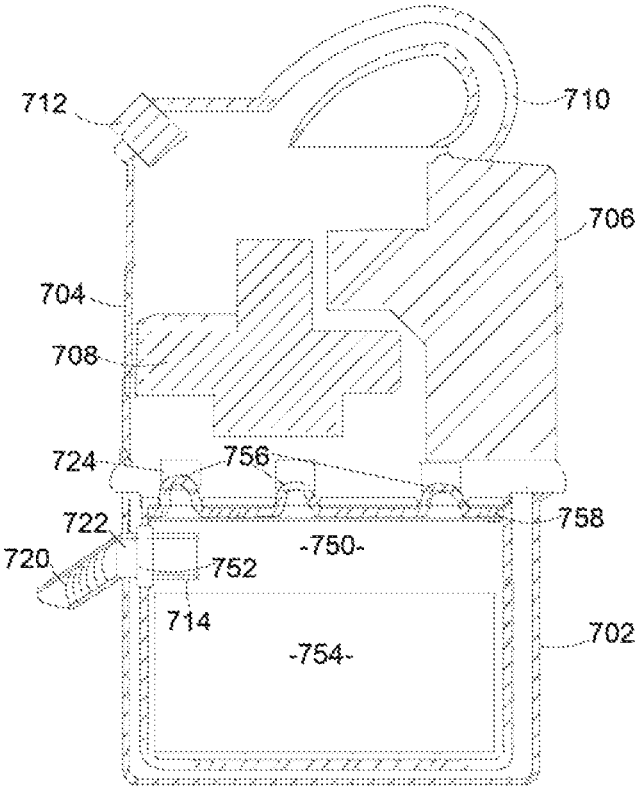
FIG. 13 is an alternate vacuum design having the flexible hose feed directly into the waste module in accordance with the invention.
Figure 14:
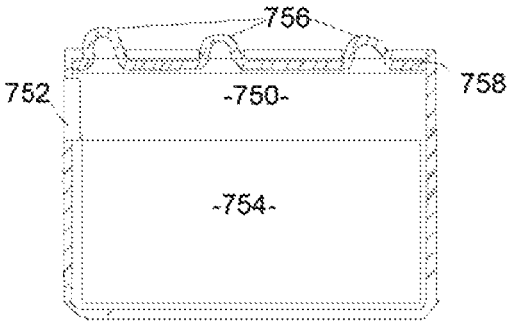
FIG. 14 is a bag design for used with the vacuum of FIG. 13 in accordance with the invention.

FIG. 13 illustrates an alternate vacuum 700 design wherein the flexible hose 720 and hose connector 722 are received by the hose sleeve 714 directly into the waste receiving receptacle 702, similar to the design used for shop vacs. In order to prevent the waste from contacting the walls of the waste receiving receptacle 702, and therefore requiring cleaning after each use, the bag 750, illustrated more clearly in FIG. 14, is extended toward the motor module 704. The bag 750 extends above the hose sleeve 714 and is connected to the hose sleeve 714 through a cardboard entry port 752. This design is similar to that used in vacuum cleaners. The insert 754 can be any of the designs illustrated heretofore as long as the insert 754 does not block the hose sleeve 714. The bag loops 756 are shorter than in prior bags as the bag 750 is closer to the bag hooks 724. The drawstring 758 must be positioned to be above the hose sleeve 714 to permit the bag 750 to pull closed upon removal of the motor module 704.

The motor module 704 contains the battery 706, motor 708, handle 710 and light 712 as described heretofore. Due to the placement of the hose connector 722 into the waste receiving module 702, the motor module 704 can be any dimensions sufficient to hold all of the elements.

Figure 15:
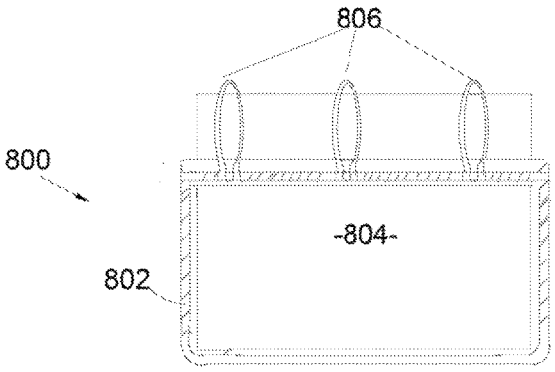
FIG. 15 is an alternate bag design for use with the vacuum of FIG. 13 in accordance with the invention.

FIG. 15 illustrates another embodiment of a bag/insert 800 arrangement that can be used with the vacuum 700. In this embodiment the bag 802 has dimensioning similar to the bags for use with the vacuum 100. The dimensioning isn't critical as long as the bag 802 sits below the hose sleeve 714 and the bag loops 806 are sufficiently long to be hooked onto the bag hooks 724. To prevent the waste from contacting the waste receiving receptacle 702 a three sided insert 804 is used. The insert 804, has its open side positioned to enable the hose sleeve 714 to extend into the waste receiving receptacle 702. The sides of the insert 804 are raised to prevent the waste from contacting the walls of the waste receiving receptacle 702.

Figure 16:
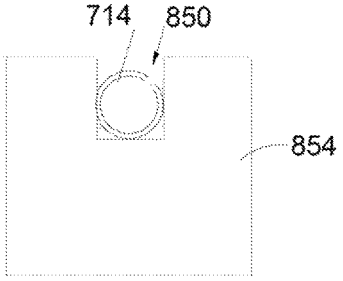
FIG. 16 is an alternate side design for the bag when used with the vacuum of FIG. 13 in accordance with the invention.

Alternatively, rather than having the entire side open as described in conjunction with insert 804, a notch 850 can be placed in a side panel 854. As illustrated in FIG. 16, the notch 850 would be dimensioned to receive the hose sleeve 714.

In FIG. 17 a bag 870 has been partially removed from the waste receptacle module 878 by the removal of the motor module 872. As can be seen the bag loops 874, still connected to the bag hooks 876, extend pulling the bag 870 closed.

The preferred embodiment for the bags herein is illustrated in FIG. 18 as bag 900. As can be seen the plastic body 910 of the bag 900 provided with loop holes 904 that are positioned to coordinate with the bag hooks of the embodiments illustrated herein. The bag loops 912 are created by the excess of a strip of material forming a drawstring 902 that is sealed within the bag body 910 when it is folded at edge 908 and sealed at seal line 906. This technology is used when making draw string trash bags, however in trash bags there are two openings and areas to draw closed. In the disclosed, the number of loop holes 904 are increased to coordinate with the number of bag hooks in the motor module being used. The excess length of the draw string 902 is determined by the distance the bag loops 912 must extend from the bag 900 to the bag hooks. This will be dependent upon the design of the vacuum and will evident to those skilled in the vacuum and plastic bag arts.

Figure 19:
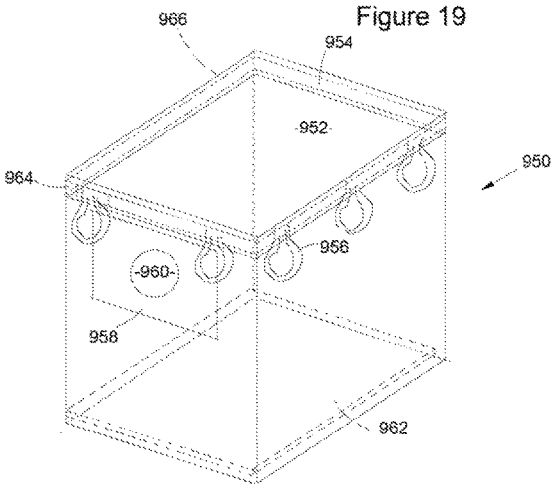
FIG. 19 is a perspective view of an alternate bag design having a closed top for use with the vacuum of FIG. 13 in accordance with the invention.

In FIG. 19 a closed bag 950 unit, with the base insert 962 placed at time of manufacture, is illustrated. In this embodiment the top 966 of the body 952 is closed, with the fold over of the top portion forming the outer layer of the channel 964. The cardboard collar 958 contains the vacuum sleeve port 960 dimensioned to receive the hose sleeve 714 of FIG. 13. The bag loops 956, formed from the drawstring 954, are dimensioned to fit the bag hooks 756 on the motor module 704.

Figure 20:
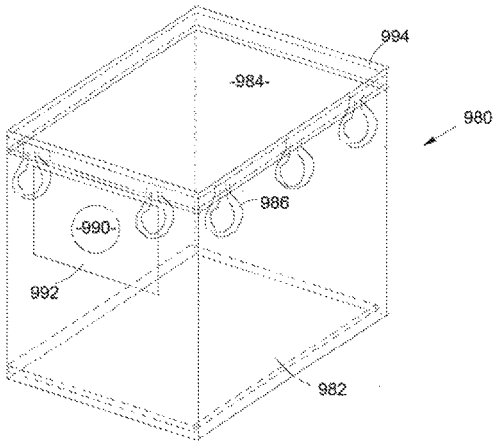
FIG. 20 is a perspective view of another bag design having an open top for use with the vacuum of FIG. 13.

Alternatively, as illustrated in FIG. 20, the top of the body 984 of the bag unit 980 is open. The channel 994 is formed from the folded over body 984 as noted heretofore with the bag loops 986 dimensioned to be received in by the bag hooks 756 of the motor module 704. In this embodiment the insert 982 can be placed into the bag body 984 either at time of manufacture or by the user at time of use. As with FIG. 19, the cardboard collar 992 contains the vacuum sleeve port 990 dimensioned to receive the hose sleeve 714.

As illustrated and disclosed heretofore the disclosed vacuum system enables users to collect waste, wet, dry or semi-dry, into an easy to dispose of bag without risking contact with the contents.

Broad Scope of the Invention

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims (e.g., including that to be later added) are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language of the present invention or inventions should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure, the following abbreviated terminology may be employed: "e.g." which means "for example."

While in the foregoing embodiments of the invention have been disclosed in considerable detail, it will understood by those skilled in the art that many of these details may be varied without departing from the spirit and scope of the invention.

What is claimed is:

1. A system for vacuuming solid and liquid waste comprising:

a. a motor module, said motor module having:
  i. a body, said body having a receiving area with a perimeter,
  ii. a motor, said motor being within said body,
  iii. a battery, said battery being removably affixed to said body to provide power to said motor,
  iv. a handle,
  v. multiple bag hooks, said multiple bag hooks being spaced a predetermined distance from adjacent bag hooks along said perimeter, b. a waste receiving module, said waste receiving module having:
  i. a receiving member, said receiving member having an open top dimensioned to receive said receiving area of said body,
  ii. at least one wall having a height extending from a base to said open top,
  iii. a closed base having a periphery,
  iv. a vacuum tube receiving area having a hose sleeve extending into said receiving area,
  v. a bag receiving area within said receiving member and being in fluid connection with said hose sleeve,
  vi. a hose connector dimensioned to receive a suction hose and being in direct fluid communication with said hose sleeve, wherein said hose sleeve and said hose connector are linearly aligned, c. disposable bags, said disposable bags having:
  i. at least one side to line said waste receiving module, at least one wall, a closed base and an open top with a bag perimeter less than the perimeter of said open top of said receiving member,
  ii. a drawstring channel, said drawstring channel being proximate said open top and having gaps within said channel, said gaps spaced a predetermined distance from subsequent gaps to receive said bag loops,
  iii. a drawstring, said drawstring positioned within said drawstring channel and having a perimeter greater than said bag perimeter to form multiple bag loops,
  iv. wherein said loops are placed over said bag hooks prior to connection of said motor module to said waste receiving module and said waste is directed from said suction hose to drop into said disposable bags and removal of said motor module from said waste receiving module pulls on said drawstring, closing said disposable bags without user contact.

2. The vacuum system of 1 wherein said disposable bags have a height less than said height of said receiving module.

3. The vacuum system of claim 1 wherein said disposable bags have a suction tube collar on one of said sides, said collar having an inlet dimensioned to receive said hose sleeve.

4. The vacuum system of claim 1 further comprising a base insert within each of said disposable bags adjacent said closed base, said base insert having a perimeter less than said disposable bag perimeter.

5. The vacuum system of claim 1 further comprising a side insert within each of said disposable bags along said at least one wall, said side insert having a perimeter less than said bag perimeter, said side insert being dimensioned to fold flat within said disposable bags.

6. The vacuum system of claim 1 further comprising a U-shaped insert within each of said disposable bags, said U-shaped insert being dimensioned to fold flat within said disposable bags.

7. The vacuum system of claim 1 wherein said disposable bags have a height equal to said height of said receiving module.

8. The vacuum system of claim 1 further comprising attachments removably affixed to an end of one of said at least one suction tube.

9. A method of vacuuming waste comprising the steps of:

i. providing a system for vacuuming solid and liquid water comprising:
  a. a motor module, said motor module having:
    1. a body, said body having a receiving area with a perimeter,
    2. a motor, said motor being within said body,
    3. a battery, said battery being removably affixed to said body to provide power to said motor,
    4. a handle,
    5. multiple bag hooks, said multiple bag hooks being spaced a predetermined distance for adjacent bag hooks along said perimeter,
  b. a waste receiving module, said waste receiving module having:
    1. a receiving member, said receiving member having an open top dimensioned to receive said receiving area of said body, 2. at least one wall having a height extending from a base to said open top,
3. a closed base having a periphery,
4. a vacuum tube receiving area having a hose sleeve extending into said receiving area,
5. a bag receiving area within said receiving member and being in fluid connection with said hose sleeve,
6. a hose connector dimensioned to receive a suction hose and being in direct fluid communication with said hose sleeve, wherein said hose sleeve and said hose connector are linearly aligned, c. disposable bags, said disposable bags having:
1. at least one side to line said waste receiving module, at least one wall, a closed base and an open top of said receiving member,
2. a drawstring channel, said drawstring channel being proximate said open top and having gaps within said channel, said gaps spaced a predetermined distance from subsequent gaps to receive said bag loops,
3. a drawstring, said drawstring positioned within said drawstring channel and having a perimeter greater than said bag perimeter to form multiple bag loops, wherein said loops are placed over said bag hooks prior to connection of said motor module to said waste receiving module and said waste is directed from said suction hose to drop into said disposable bags and removal of said motor module from said waste receiving module pulls on said drawstring, closing, said disposable bags without user contact, ii. inserting a disposable bag having at least one side, a closed base and an open top with a drawstring within a drawstring channel, and bag loops extending from gaps in said channel, into said waste receiving module iii. placing said bag loops onto said bag hooks, iv. locking said motor module to said waste receiving module, v. inserting suction tubes into a receiving area, vi. vacuuming said waster, viii. causing said bag loops on said bag hooks to pull said drawstring, ix. closing said bag by removing said motor module, x. removing said bag loops from said bag hooks, and xi. disposing of said closed bag.

* * * * *